United States Patent [19]

Lindahl et al.

[11] 4,294,653

[45] Oct. 13, 1981

[54] PROCESS FOR MANUFACTURING CHEMIMECHANICAL CELLULOSE PULP IN A HIGH YIELD WITHIN THE RANGE FROM 65 TO 95%

[75] Inventors: Jonas A. I. Lindahl, Domsjoverken; Lars G. Rudstrom, Husum, both of Sweden

[73] Assignee: Mo och Domsjo Aktiebolag, Ornskoldsvik, Sweden

[21] Appl. No.: 895,163

[22] Filed: Apr. 11, 1978

Related U.S. Application Data

[63] Continuation-in-part of Ser. No. 615,625, Sep. 22, 1975, abandoned.

[30] Foreign Application Priority Data

Sep. 23, 1974 [SE] Sweden ..... 7411949

[51] Int. Cl.[2] ..... D21B 1/16; D21D 1/20

[52] U.S. Cl. ..... 162/25; 162/26; 162/28; 162/37; 162/40; 162/72; 162/78; 162/83

[58] Field of Search ..... 162/20, 25, 26, 28, 162/60, 65, 37, 40, 78, 83, 72, 24

[56] References Cited

U.S. PATENT DOCUMENTS

| | | | |
|---|---|---|---|
| 2,413,583 | 12/1946 | Shearer | 162/78 |
| 2,561,043 | 7/1951 | Ayers | 162/20 |
| 3,446,699 | 5/1969 | Asplund et al. | 162/28 |
| 3,653,804 | 4/1972 | Janson et al. | 162/83 |
| 3,694,309 | 9/1972 | Gierer et al. | 162/78 |
| 3,759,783 | 9/1973 | Samuelson | 162/40 |
| 3,811,995 | 5/1974 | Ringley | 162/28 |
| 3,830,688 | 8/1974 | Mannbro | 162/65 |
| 3,873,412 | 3/1975 | Charters et al. | 162/28 |
| 4,029,543 | 6/1977 | Lindahl | 162/40 |

FOREIGN PATENT DOCUMENTS

| | | | |
|---|---|---|---|
| 970111 | 7/1975 | Canada | 162/65 |
| 2450919 | 4/1976 | Fed. Rep. of Germany | 162/65 |

OTHER PUBLICATIONS

MacDonald et al., Editor, *The Pulping of Wood*, pp. 262–275, New York, 1969.

*Primary Examiner*—S. Leon Bashore
*Assistant Examiner*—Steve Alvo

[57] ABSTRACT

A process is provided for the manufacture of bleached chemimechanical cellulose pulp in high yield of between 65 and 95% from particulate and preferably washed lignocellulosic material, such as wood chips, featuring the use of spent or waste bleaching liquid, preferably from a lignin-preserving bleaching process, in at least one stage of the process where a cooling and diluting liquid is required, such as during mechanical defibration of the material.

33 Claims, 2 Drawing Figures

Figure 1:
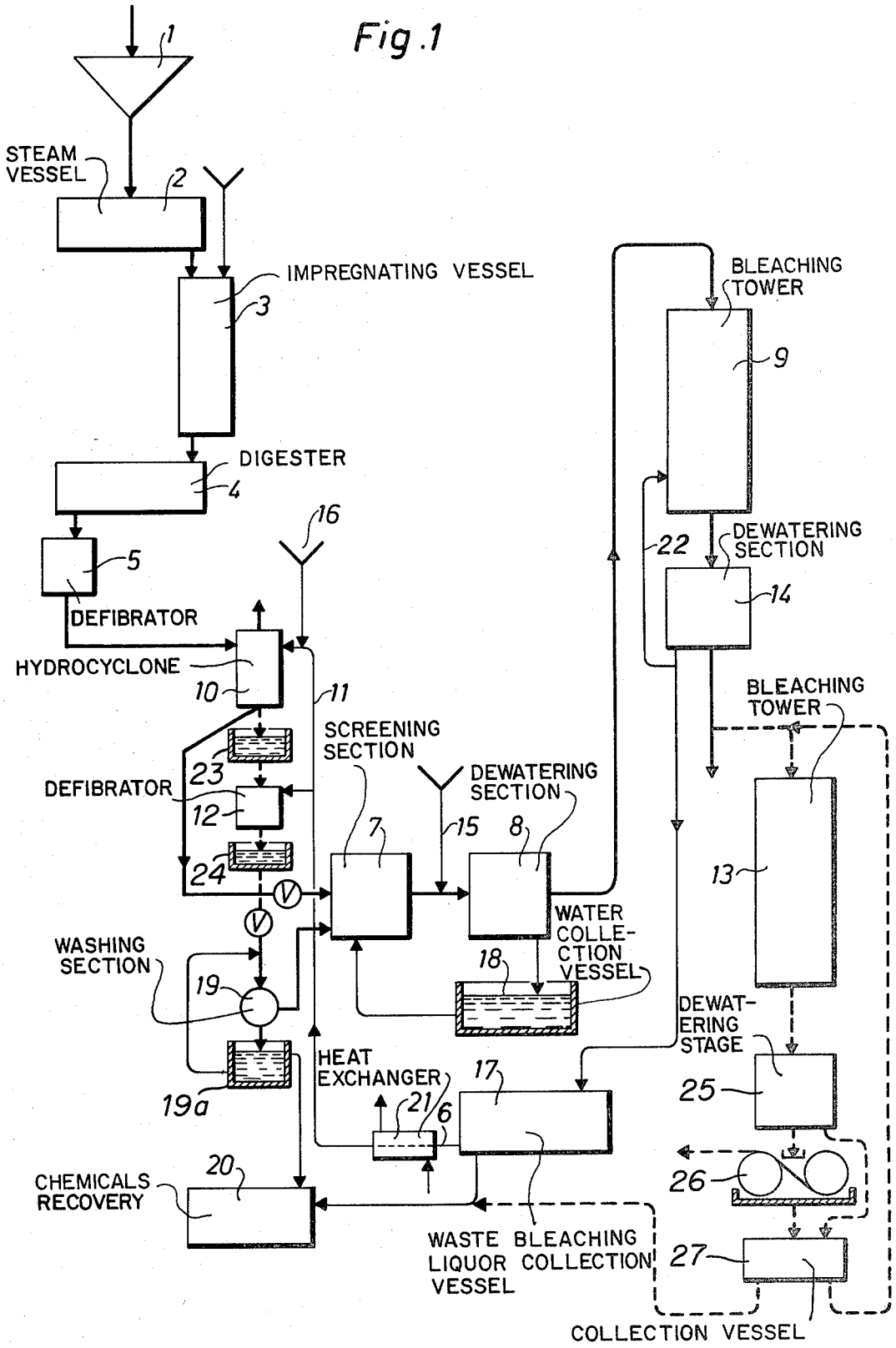

1
STEAM VESSEL
2
IMPREGNATING VESSEL
3
DIGESTER
4
5
DEFIBRATOR
HYDROCYCLONE
10
11
16
23
DEFIBRATOR
12
24
WASHING SECTION
19
19a
SCREENING SECTION
7
15
DEWATERING SECTION
8
WATER COLLECTION VESSEL
18
HEAT EXCHANGER
21
6
17
CHEMICALS RECOVERY
20
WASTE BLEACHING LIQUOR COLLECTION VESSEL
BLEACHING TOWER
9
22
DEWATERING SECTION
14
BLEACHING TOWER
13
DEWATERING STAGE
25
26
27
COLLECTION VESSEL

PROCESS FOR MANUFACTURING CHEMIMECHANICAL CELLULOSE PULP IN A HIGH YIELD WITHIN THE RANGE FROM 65 TO 95%

This application is a continuation-in-part of Ser. No. 615,625, filed Sept. 22, 1975, and now abandoned.

As raw lignocellulosic material becomes less available, and its cost increases, it becomes increasingly important to obtain high pulp yields. However, a high pulp yield is not acceptable, if it is at the expense of the quality of the pulp, or results in increased manufacturing cost, or increased pollution of the environment.

High yield cellulose pulp has been produced by applying pressure to chips in a screw press, and then releasing the pressure, repeating the cycle many times, with the chips being compressed and then permitted to expand in each cycle, while the chips are sprayed with an aqueous solution of a pulping chemical such as sodium peroxide or sodium sulfite, to give a partial pulping or digestion of the wood. However, the pulp produced by this method has unsatisfactory brightness, no better than the also unsatisfactory conventional mechanical pulp manufactured by grinding and bleaching operations.

Newsprint and similar cellulose pulps are prepared from particulate lignocellulosic material by grinding in the presence of spent bleaching liquor. Fresh bleaching chemicals may also be used. Alternatively, the defibration of the lignocellulosic material can be carried out in a disc refiner, or in a screw defibrator, such as a FROTAPULPER®. Such pulp is referred to as groundwood pulp, and, compared with conventional mechanical pulp, it is both stronger and brighter. However, compared with chemical pulps, such pulps are inferior both in strength and in brightness.

Chemimechanical and semichemical cellulose pulps have also been prepared from particulate lignocellulosic material such as wood chips in a disc refiner at a high pulp consistency. The refining is effected relatively dry (in the absence of added liquid), at a superatmospheric pressure of up to 10 kp/cm$^2$. The friction arising from absence of a cooling liquid lubricant causes the material to become quite hot during the defibration. The pieces of lignocellulose material are subjected to high torque and shear forces in the disc refiner, which divide the pieces into separate fibers in planes between the original fibers. The resulting pulp has fibers which are coated with lignin, resin, and similar materials.

This process is capable of producing relatively long fiber pulp, in a high yield of between about 50 and about 90%, but this advantage is offset to some extent because of the discoloration of the pulp which is due to the refining at high temperatures, since the cellulosic material is in a relatively dry condition. Thus, such pulps also have a poor brightness, and furthermore, the pulp contains a relatively high quantity of impurities. However, the process does have economic advantages, owing to the low cost of the equipment, and the saving in processing time.

In accordance with the invention, an improved process is provided for the manufacture of chemimechanical or semichemical cellulose pulp in high yields within the range from about 65 to about 95% from particulate and preferably washed lignocellulosic material, such as wood chips, sawdust, and similar materials. In the process of the invention, the particulate washed lignocellulosic material is heated with steam, or subjected to a mild digestion in the presence of a delignifying agent, or to a combination of both these steps. The treated material is then defibrated and refined, either with or without the application of pressure, in a disc refiner or other defibrator or refiner apparatus suitable for use with particulate lignocellulosic material, blending the partially digested lignocellulosic material before defibration is more than 50% complete with a cooled, spent, or waste bleaching liquor from a lignin-preserving bleaching process, preferably from a bleaching of a previous portion of lignocellulosic material in the same process, for cooling and/or dilution of suspension prior to the completion of the defibration of the lignocellulosic material to form pulp. The refined pulp suspension is screened and dewatered, and the dewatered cellulosic material is then bleached by a lignin-preserving bleaching process, using oxidizing or reducing lignin-preserving bleaching agents, and then passed to a second dewatering stage. The diluting and cooling liquid used is a cool waste lignin-preserving bleaching liquor having a pH within the range from about 6 to about 12, and preferably from about 6.5 to about 10. Suitably the temperature of the waste bleaching liquor after cooling is below 40° C. and preferably below 20° C.

The process of the invention gives a considerably reduced consumption of bleaching chemicals, in comparison with the previously known processes for producing mechanical pulps, resulting in lower processing cost, and also reducing pollution of the environment with by-products of the process. The chemimechanical or semichemical pulp that is obtained has an increased mechanical strength, which makes it possible to prepare a strong paper sheet of relatively low density.

The chemimechanical or semichemical pulp obtained by the process of the invention can be blended with chemical pulp, such as sulfate or sulfite pulp, and in such mixtures a small quantity of chemical pulp will give a paper having an improved strength and brightness, thereby reducing the cost of such paper.

The chemimechanical or semichemical pulp produced in accordance with the invention has a high degree of purity, and satisfactory brightness and strength, and a greater absorptivity than mechanical pulps produced by known processes. Consequently, the pulps produced by the process of the invention can be used for the manufacture of a broader spectrum of papers than what is possible when using known pulps produced with a high yield ranging as high as from about 65 to about 95%.

Figure 2:
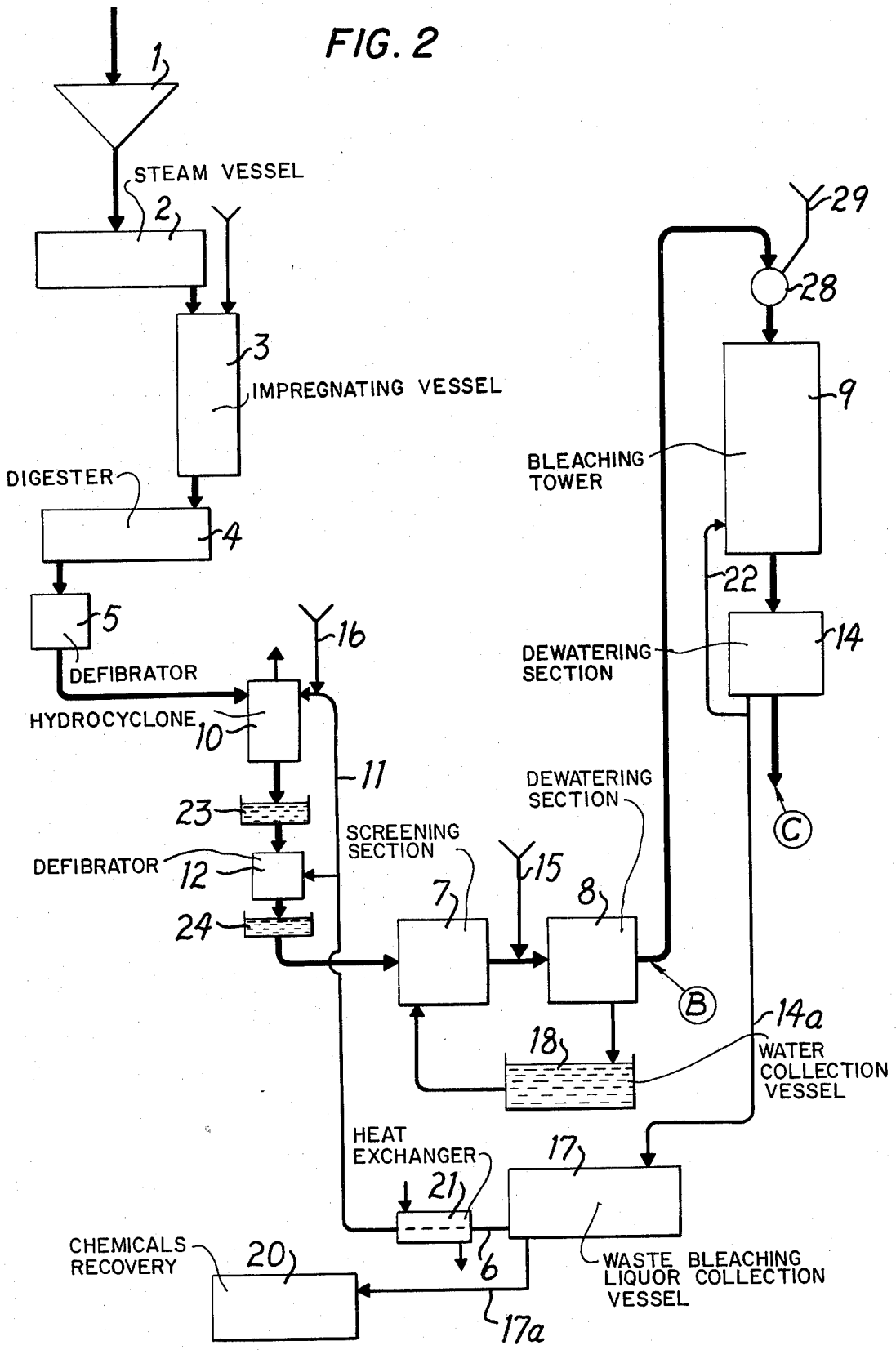

FIG. 1 and FIG. 2 are each flow sheets showing the several steps of two embodiments of the process of the invention.

The flow sheet of FIG. 1 shows the system used in Examples 1 and 2; the flow sheet of FIG. 2 shows the system used in Example 3.

As is seen from FIG. 1, particulate and preferably washed lignocellulosic material such as, for example, wood chips, enters the process from a surge bin 1, from which it is passed to the steam vessel 2, where the chips are treated with steam at atmospheric pressure for a length of time sufficient to moisten the chips. The steam-moistened chips are then passed to the impregnating vessel 3, provided with a screw feeder. In this vessel the chips are impregnated with a solution of a pulping or delignifying chemical, such as for example, an aqueous sodium bisulfite solution. As they absorb the impregnating solution, the chips expand and increase in weight by approximately 100%, while absorbing their own weight of impregnating solution.

The impregnated chips are passed by the screw feeder from the vessel 3 to a digester 4, also provided with a screw feeder. The chips are passed continuously through the digester 4, and as they pass through the digester, they are partially pulped by the pulping chemicals in the vapor phase at an elevated temperature. The rate of progress of chips through the digester 4 is adjusted to give the desired dwell time of the impregnated chips in the digester 4, so that the desired yield of the material is obtained by the time it leaves the digester.

The partially digested chips then are passed to a first defibration stage at defibrator 5, such as for example, a disc refiner, and partially defibrated while still impregnated with the pulping chemicals at the pulping temperature. Following defibration in the defibrator 5, the material is passed to a hydrocyclone 10, in which waste lignin-preserving bleaching liquor 11 is continuously supplied, for diluting and cooling the cellulose pulp suspension. Such waste bleaching liquor has its origin in the recovery vessel 17, and is recycled in the system. If necessary, the pH of the waste bleaching liquor for introduction into hydrocyclone 10 is adjusted at 16 by mixing a suitable buffer solution, prior to supplying it to the hydrocyclone 10.

The fiber suspension from the hydrocyclone 10 is then passed to a reaction vessel 23 and after a suitable retention time to a second defibrator 12, where the defibration is completed, and thence via equalizing vessel 24 to the screening section 7. If desired, waste lignin-preserving bleaching liquor can also be added in this defibrator, for dilution and cooling, from line 11.

In an alternative and preferred embodiment of the invention, the completely defibrated pulp suspension from the second defibrator 12 is passed via the equalizing vessel 24 to a washing section 19, and thence to the screening section 7. The wash water is recovered in the collection vessel 19*a*, and then recycled. Excess wash water collected in vessel 19*a* is passed to a chemicals recovery plant 20.

During passage of the completely defibrated and screened pulp fiber suspension between the screening section 7 and the dewatering section 8, complexing agents for taking up heavy metal ions are supplied to the suspension via line 15.

The dewatered pulp fiber suspension is then subjected to a lignin-preserving bleaching process, being passed to the top of a bleaching tower 9 where lignin-preserving oxidizing or reducing bleaching agents are blended therewith, and the mixture then descends through the bleaching tower, the descent time corresponding to the dwell time in the tower and being sufficient to effect the desired bleaching. The bleached pulp is then passed through a further dewatering section 14, and then to a drying station (not shown). Alternatively, it can be passed directly to the paper-making section of the pulp mill. Waste bleaching liquor obtained in the dewatering section 14 is collected in the vessel 17, whence it can again be recycled to the system through line 6 via a heat exchanger 21. Part of the waste bleaching liquor obtained in the dewatering section 14 is recycled via line 22 to the bottom section of the bleaching tower 9, where it is used for dilution of the bleached pulp suspension.

The waste digestion liquor and excess waste bleaching liquor washed from the material in the washing station 19 is then sent from vessel 19*a* to the chemicals recovery plant 20, where the chemicals are recovered and recycled, to, for example, impregnating vessel 3 and/or digester 4.

As a further alternative, the cellulose pulp suspension from the second dewatering stage 14 can be subjected to a second bleaching, in a second bleaching stage 13, using reducing bleaching agents in a lignin-preserving bleaching process. If an oxidizing lignin-preserving bleaching agent is used, such as a peroxide, the waste bleaching liquor from this bleaching stage can also be passed to the collection vessel 17. When reducing bleaching agents such as dithionite are used in the second bleaching stage, the waste bleaching liquor is passed directly to the recovery plant 20 via the dewatering stage 25, the paper machine 26, and the collection vessel 27.

A preferred route giving good results proceeds via defibrator 5 and the hydrocyclone 10, in which the chilled waste bleaching liquor is continuously supplied by pipe 11, whence the diluted and cooled fiber suspension is passed through the second defibrator 12, and then to the washing section 19, the screening section 7 and dewatering section 8, followed by bleaching in two stages, oxidizing and reducing. This route is illustrated in Examples 1 and 2. The recycled waste bleaching liquor blended into the hydrocyclone 10 is from the first oxidizing bleaching stage. The waste bleaching liquor from the second reducing stage preferably is passed directly to the recovery plant 20.

The waste bleaching liquor can, if desired, be used for dilution and cooling of the lignocellulosic material at stages other than those shown in FIG. 1, in addition to or in place of those shown.

For the manufacture of pulp, where no delignifying chemicals are used prior to the defibration in the defibrator 5, the washed, raw, particulate lignocellulosic material is, for example, passed directly from the surge bin 1 to the digester 4, or if desired, by way of the steam-moistening vessel 2. The waste bleaching liquor is then introduced prior to or during the defibrating stage in the defibrator 5, such as by introducing it into the impregnating vessel 3 or into the digester 4.

As is seen from FIG. 2, particulate and preferably washed lignocellulosic material (such as, for example, wood chips) enters the process from a surge bin 1, from which it is passed to the steam vessel 2, where the chips are treated with steam at atmospheric pressure for a length of time sufficient to moisten the chips. The steam-moistened chips are then passed to the impregnating vessel 3, provided with a screw feeder. In this vessel the chips are impregnated with a solution of a pulping or delignifying chemical, such as for example, an aqueous sodium bisulfite solution. As they absorb the impregnating solution, the chips expand and increase in weight by approximately 100%, while absorbing their own weight of impregnating solution.

The impregnated chips are passed by the screw feeder from the vessel 3 to a digester 4, also provided with a screw feeder. The chips are passed continuously through the digester 4, and as they pass through the digester, they are partially pulped by the pulping chemicals in the vapor phase at an elevated temperature. The rate of progress of chips through the digester 4 is adjusted to give the desired dwell time of the impregnated chips in the digester 4, so that the desired yield of the material is obtained by the time it leaves the digester.

The partially digested chips then are passed to a first defibration stage at defibrator 5, such as for example, a disc refiner, and partially defibrated while still impregnating with the pulping chemicals at the pulping temperature. Following defibration in the defibrator 5, the material is passed to a hydrocyclone 10, in which waste lignin-preserving bleaching liquor 11 is continuously supplied, for diluting and cooling the cellulose pulp suspension. Such waste bleaching liquor has its origin in the recovery vessel 17, and is recycled in the system. If necessary, the pH of the waste bleaching liquor for introduction into hydrocyclone 10 is adjusted at 16 by mixing a suitable buffer solution, prior to supplying it to the hydrocyclone 10.

The fiber suspension from the hydrocyclone 10 is then passed to a reaction vessel 23 and after a suitable retention time to a second defibrator 12, where the defibration is completed, and thence via equalizing vessel 24 to the screening section 7. If desired, waste lignin-preserving bleaching liquor can also be added in this defibrator, for dilution and cooling, from line 11.

During passage of the completely defibrated and screened pulp fiber suspension between the screening section 7 and the dewatering section 8, complexing agents for taking up heavy metal ions are supplied to the suspension via line 15.

The dewatered pulp fiber suspension is then subjected to a lignin-preserving bleaching process, being passed to the top of a bleaching tower 9 where lignin-preserving oxidizing or reducing bleaching agents are blended therewith, and the mixture then descends through the bleaching tower, the descent time corresponding to the dwell time in the tower and being sufficient to effect the desired bleaching. The bleached pulp is then passed through a further dewatering section 14, and then to a drying station (not shown). Alternatively, it can be passed directly to the paper-making section of the pulp mill. Waste bleaching liquor obtained in the dewatering section 14 is sent via line **14*a* and collected in the vessel 17, whence it can again be recycled to the system through lines 6 and 11 via a heat exchanger 21. Part of the waste bleaching liquor obtained in the dewatering section 14 is recycled via line 22 to the bottom section of the bleaching tower 9**, where it is used for dilution of the bleached pulp suspension.

The waste digestion liquor and excess waste bleaching liquor collected in vessel 17 is then sent via line **17*a* to the chemicals recovery plant 20, where the chemicals are recovered. These chemicals can be recycled, to, for example, impregnating vessel 3 and/or digester 4**.

As a further alternative, the cellulose pulp suspension from the second dewatering stage 14 can be subjected to a second bleaching, in a second bleaching stage, using reducing bleaching agents in a lignin-preserving bleaching process. If an oxidizing lignin-preserving bleaching agent is used, such as a peroxide, the waste bleaching liquor from this bleaching stage can also be passed to the collection vessel 17. When reducing bleaching agents such as dithionite are used in the second bleaching stage, the waste bleaching liquor is passed directly to the recovery plant 20.

Suitable delignifying agents for a mild digestion, in accordance with the invention, are sodium bisulfite, sodium hydroxide, sodium carbonate and sodium bicarbonate, magnesium carbonate and magnesium bicarbonate.

By "mild digestion process" is meant a digestion effected at a temperature within the range from about 80° to about 180° C., at a superatmospheric pressure within the range from 0 to 20 kp/cm$^2$. The digestion is continued until the desired yield is obtained, which normally is represented by a Kappa number within the range from about 50 to about 150, but the time required to reach this Kappa number will of course vary with the raw lignocellulosic material.

The first incomplete defibration effected in the defibrator 5 employs equipment suitable for disintegrating particulate lignocellulosic material, preferably in the form of a disc refiner, and is carried out at a temperature within the range from about 80° to about 180° C. at a superatmospheric pressure within the range from about 0.5 to about 10 kp/cm$^2$.

The second defibration in defibrator 12 can be carried out at a temperature within the range from about 40° to about 100° C., preferably from about 80° to about 90° C., and at atmospheric pressure. The fiber suspension from the hydrocyclone 10 is preferably kept for 5 to 30 minutes in the reaction vessel 23 before being passed on to the second defibrator 12. Suitable defibrators for use in this stage include not only disc refiners but also conical mills and screw defibrators, such as a FROTAPULPER®.

During the mechanical defibration of the lignocellulosic material, heat is generated, which causes high temperatures to be reached during the defibration. Consequently, during the defibration, preferably in the first stage, and desirably also in the second and any additional stages, cooling and diluting liquid should be present. If the pulp has been subjected to a mild digestion, the liquid can be excess pulping or delignifying solution, which will act to retard the discoloration of the lignocellulosic material, due to the high temperature of the defibration. If the pulp has not been so subjected, waste bleaching liquor can be used, and for the purpose this liquor can be introduced into the digester or in another stage before the defibration.

The wear on the working surfaces of the defibrator, for example, the grinding discs, introduces heavy metal ions, such as iron, manganese, nickel and copper, into the defibrated cellulosic material, which results in discoloration. To counteract this discoloration, complexing agents for such metals can be added prior to bleaching the cellulose pulp suspension. The use of waste aqueous bleaching liquor for dilution and cooling of the defibrated pulp also results in a certain desirable complexing of heavy metal ions, due to complexing materials present in this liquor, and this also results in a brighter pulp.

In practice, it is desirable to add to the pulp suspension prior to bleaching excess complexing agent in an amount beyond that theoretically required to complex the heavy metals. Too little complexing agent can have a deleterious effect on the brightness of the pulp. When the material is bleached with peroxide or other oxidizing bleaching agent, organic acids are formed in the bleaching liquor, and these when recycled with the waste bleaching liquor assist in complexing the metal ions.

Suitable oxidizing bleaching agents that provide a lignin-preserving bleaching effect for bleaching in accordance with the invention include hydrogen peroxide, sodium peroxide, and peracetic acid. Suitable reducing bleaching agents include sodium dithionite (sodium hydrosulfite), sulfur dioxide, sodium bisulfite, sodium sulfite, hydroxylamine, hydrazine, thiourea and thioglycolic acid.

Bleaching agents which are capable of bleaching cellulose pulp while preserving the lignin therein are well known, and are to be distinguished from other types of bleaching agents which also effect delignification in the course of bleaching, such as oxygen and alkali. U.S. Pat. No. 3,694,309 to Gierer et al describes a process for bleaching cellulose pulp while preserving the lignin therein, utilizing lignin-receiving bleaching agents.

Since delignification does not occur to any significant extent using such bleaching agents, the resulting waste bleaching liquor is either colorless or only very slightly colored, i.e., light yellow. On the other hand, oxygen-alkali bleaching delignifies the cellulose pulp to a considerable extent. Croon and Andrews in an article in TAPPI 54 11 1893-1898 (1971), *Advances in Oxygen Bleaching*, state that the oxygen-alkali process is a delignification method which is intended for use following conventional pulping. Using oxygen as the first stage, it is possible to reduce the Kappa number from 32 to 35 to from 16 to 17, and obtain a 50% decrease in the lignin content, while retaining the ultimate goal of 92% SCAN brightness and 900 $cm^2/g$ SCAN viscosity. As a consequence of the considerable delignification occurring in the course of oxygen-alkali bleaching, the waste oxygen-alkali bleaching liquor has a dark brown to black color, and because of this color, it and similar bleaching agents are not suitable for use in the process of the present invention. Moreover, such bleaching liquor is lacking in the residual content of bleaching agent which is capable of preserving the lignin, and which is utilized in the present invention as a part of the waste bleaching liquor.

If the lignin-preserving bleaching is effected with peroxide, the waste bleaching liquor will contain peroxide residues in an amount from about 0.1 to about 2 g/l hydrogen peroxide. When this waste bleaching liquor is reused as a diluting and cooling liquid for the partially defibrated cellulose material, the peroxide residues bleach the cellulose material, and assist in maintaining its brightness at an early stage of the process.

In the waste lignin-preserving bleaching liquor obtained from a peroxide bleaching process, there is also found sodium silicate, sodium hydroxide, and traces of magnesium sulfate. These chemicals have a stabilizing effect on hydrogen peroxide, and raise the pH of the suspension. When the partially defibrated suspension is defibrated in a second stage, the second defibration may be effected at a higher pH than when no waste bleaching liquor is supplied, subsequent to the first defibration.

A suitable waste bleaching liquor from an oxidizing peroxide bleaching process should (and usually does) have the following composition:

| Component | g/liter |
|---|---|
| Hydrogen peroxide | 0.1-2 |
| Sodium hydroxide | 0.1-2 |
| $Na_2SiO_3$ | 0.5-8 |
| Complexing agents (e.g. DTPA or EDTA) | 0.01-1 |
| $MgSO_4$ | 0.01-1 |
| Organic acids which readily form complexes with heavy metal ions | amount depending on type of raw material used. |
| Oxidized organic material residues, such as fiber particles, organic acids, sodium fatty acid soaps, etc. | |

The residues are advantageous in the recovery plant, where they give a higher fuel rating, and facilitate the recovery of the chemicals used.

When the waste bleaching liquor is obtained from a bleaching stage in which sodium hydrosulfite or dithionite is used as a bleaching agent, the waste bleaching liquor will contain sodium sulfite, sodium bisulfite, sodium thiosulfate, and minor quantities of sodium dithionite and complexing agents. These compounds on recycling have a reducing bleaching effect on the defibrated cellulosic material, and this also occurs at a desirable early stage of the process.

A suitable waste bleaching liquor from a reducing sodium dithionite bleaching stage should (and usually does) have the following composition:

| Component | g/liter |
|---|---|
| Sodium dithionite | 0.01-0.4 |
| Sodium sulfite | 0.05-0.8 |
| Sodium bisulfite | 0.05-0.8 |
| Sodium thiosulfate | 0.05-0.8 |
| Complexing agents | 0.005-0.5 |

This type of waste bleaching liquor usually has a pH below 7, and the composition is such that it can be used directly in the digestion stage.

The recycled waste bleaching liquor has about the same effect wherever added in accordance with the invention, as long as it is well blended with the fibrous suspension.

If an alkaline waste bleaching liquor is used in the second defibration stage 12, there is obtained a stronger pulp than when the defibration is effected in a weak or strong acid environment. Thus, the pH of the waste bleaching liquor may be adjusted to put it on the alkaline side, when greater strength in the pulp is desired.

When the defibrated cellulose pulp is passed to a hydrocyclone, such as the hydrocyclone stage 10, surplus steam is separated from the defibrated material, together with pulping chemical residues. According to known techniques, cold water is used in the hydrocyclone for dilution and cooling purposes.

During rapid cooling of a defibrated lignocellulosic material prepared in the usual way, dissolved particles of extracted substances such as resin agglomerates may adhere to the fibers. This resin in the lignocellulosic material may give rise to extensive resin deposits through the system, thereby creating problems which are difficult to resolve, without shutting down and cleaning up the equipment.

In the process of the invention, however, when chilled alkaline waste bleaching liquor is added to the defibrated fiber suspension, either no resin or only a negligible amount of resin is precipitated, which is a considerable advantage.

It is thus particularly advantageous to pass the alkaline waste bleaching liquor as the diluting liquid into the hydrocyclone. This provides a good, homogeneous mixture with the fibrous suspension.

It is not at present understood why resin deposits are not obtained in the process of the invention. It is possible, however, especially when an alkaline waste bleaching liquor is used, that the waste liquor forms soluble sodium soaps with the resins, and with the fatty acids normally present in wood cellulose. The formation of sodium soaps is facilitated by the fact that the complexing agents reduce the content of heavy metal ions, which otherwise would form insoluble heavy metal soaps, which are less readily dispersed than sodium soaps and are less good emulsifying agents for resin.

Since one of the functions of the waste lignin-preserving bleaching liquor supplied to partially defibrated pulp from the defibrator stage 5 is to cool the defibrated pulp, it is desirable to cool the waste bleaching liquor. However, the cooling has to be carried out with a view to the temperature required for the bleaching process, since if the pulp fibers are cooled down too much, they will then have to be heated again for bleaching.

For cooling purposes, the waste lignin-preserving bleaching liquor may be passed through a heat exchanger, such as the exchanger 21 shown in FIG. 1 and FIG. 2, to heat fresh cold water. Suitably the temperature of the waste bleaching liquor after cooling is below 40° C. and preferably below 20° C. The heated fresh water can then be used for preparing pulping or digestion solution and/or bleaching solution, as may be required in the process. A portion of the stream of waste bleaching liquor can also be used to prepare such solutions.

When the delignifying chemicals are recovered after the first or second defibration stage, waste bleaching liquor is also recovered at the same time. The addition of waste bleaching liquor for dilution of the defibrated lignocellulosic material has the advantage that a higher content of chemicals and organic substances is present in the liquor recovered at the conclusion of the process, which gives the waste liquor a higher fuel rating, and facilitates chemical recovery. Since normally waste bleaching liquor from a peroxide bleaching stage discharged to the environment, such as in a pond or stream, may have a biochemical oxygen demand of up to 15 to 20 kg per ton of bleached pulp, the fact that waste bleaching liquor is recovered in the process of the invention is of considerable significance in avoiding environmental pollution. As a result of the recovery of the waste bleaching liquor in accordance with the invention, the waste liquors discharged to streams and ponds from the process of the invention have a biochemical oxygen demand that is from 50 to 70% lower than normal.

When the waste digestion liquor is not recovered, the process of the invention yields a brighter and less offensive waste liquor, owing to the fact that the waste bleaching liquor added to the system contains bleaching agent residues. It is particularly advantageous in this respect if the waste bleaching liquor contains peroxide residues, since these assist in decomposing organic compounds in the materials discharged from the system.

When the only chemicals used in the process are bleaching chemicals, that is, when no digestion chemicals are used, as in a thermomechanical pulping process, the not recycled portion of the waste bleaching liquor can be transferred and regenerated in a cross recovery system.

The process in accordance with the invention is illustrated in the following Examples, which represent preferred embodiments of the invention.

EXAMPLE 1

Spruce chips having a length of 40 mm, a width of 20 mm and a thickness of 3 mm, were processed using a system as shown in FIG. 1. First, the chips were treated with steam in vessel 2 at atmospheric pressure for fifteen minutes. The steam-moistened chips were then fed from the vessel 2 to the impregnating vessel 3 provided with a screw feeder, and impregnated with aqueous sodium bisulfite solution comprising 65 g of sodium hydroxide and 68 g of sulfur dioxide per liter, having a pH of 6.0. During impregnation of the chips with the bisulfite solution, the chips took up approximately 100% by weight of the solution. The impregnated chips were then passed to the digester 4, where they were mildly pulped in vapor phase for twenty minutes at 160° C. The digested chips were then passed to the defibrator 5, a disc refiner, and partially defibrated at the same temperature and a pulp consistency of 40% to a freeness of 650 ml. No waste lignin-preserving bleaching agent was employed in this defibration. Freeness is a measurement of the drainage resistance of the pulp, and is measured according to the Canadian Standard Freeness Method (CSF). The pulp yield was 89%.

The partially defibrated pulp was then divided into two portions, A and B, for further defibration and bleaching.

Portion A was diluted with water to a pulp consistency of 20% and defibrated further by refining in a disc refiner.

Portion B was diluted in accordance with the invention with a cooled waste bleaching liquor containing 0.8 g hydrogen peroxide, 0.5 g NaOH, 2.5 g $Na_2SiO_3$, 0.03 g diethylenetriaminepentaacetic acid, and 0.02 g magnesium sulfate, per liter of waste bleaching liquor. The waste bleaching liquor also contained oxidized organic material residues from the bleaching, mainly comprising fine fiber particles and organic acids. The pH of the waste bleaching liquor was 8.8. The pulp consistency of portion B after dilution was 20%.

After holding portion B for five minutes at 75° C., the portion was then defibrated further by refining in the same manner as A. Both portions were screened and dewatered in an identical manner. Samples of the resulting pulps were then tested, with the following results:

TABLE I

| | | CONTROL Portion A | EXAMPLE 1 Portion B |
|---|---|---|---|
| Freeness, CSF | | 200 ml | 205 ml |
| Fiber composition, Bauer McNett fractionating | + 20 mesh | 8% | 7.5% |
| | + 150 mesh | 70% | 73.5% |
| | − 150 mesh | 22% | 19% |
| Brightness, SCAN | | 62.3% | 66.1% |
| Breaking length | | 3900 m | 4800 m |
| Tear factor | | 69 | 74 |
| Absorptivity (g water/g pulp) | | 9.3 | 12.1 |

The data in the Table show that the chemimechanical pulp produced in accordance with the invention, Portion B, utilizing waste lignin-preserving bleaching liquor, was brighter and stronger than the pulp produced in accordance with the prior procedure, Portion A. In addition, the chemimechanical pulp obtained by the process of the invention had a greater water absorptivity, which is of great significance in many fields of use. Moreover, a more favorable fiber composition is obtained by the process of the invention, as is shown by the increase in the percentage of fibers caught on a 150 mesh screen.

The pulps A and B were then subjected to a sixty minute single-stage bleaching process using aqueous 0.8% sodium dithionite $Na_2S_2O_4$ (calculated on the bone dry weight of the pulp)at 70° C. and a pulp consistency of 4%. The degree of brightness of the resulting pulps were then found to be as follows:

| | % SCAN |
|---|---|
| Portion A | 67.3 |
| Portion B | 71.0 |

Another portion of the two pulps A and B (portions $A_1$ and $B_1$) was subjected to a single-stage bleaching process using a hydrogen peroxide solution containing 2% hydrogen peroxide, 4% sodium silicate $Na_2SiO_3$, 1.5% sodium hydroxide NaOH, and 0.05% magnesium sulfate $MgSO_4$ (all calculated on the bone dry weight of the pulp) for 120 minutes at a 12% pulp consistency. The following degrees of brightness were obtained:

| | % SCAN |
|---|---|
| Portion $A_1$ | 69.5 |
| Portion $B_1$ | 71.8 |

It is apparent from the data that both a reducing bleaching process with dithionite and an oxidizing bleaching process with peroxide give a brighter end product, in producing the pulp in accordance with the invention, pulps B and $B_1$, than the pulp produced in accordance with the prior process, pulps A and $A_1$. Thus, the addition of fresh bleaching chemicals can be reduced in the process of the invention, while still maintaining the brightness of the pulp.

EXAMPLE 2

Pine chips having a length of 40 mm, a width of 20 mm, and a thickness of 3 mm, were processed using the system shown in FIG. 1. First, the pine chips were washed, and then they were steam-moistened in a vessel 2 at atmospheric pressure for fifteen minutes. Then, they were impregnated in the impregnating vessel 3, while permitting the chips to swell, using an aqueous sodium bisulfite solution containing 75 g NaOH and 72.1 sulfur dioxide per liter. The pH of the solution was 6.2. The impregnated chips took up approximately 100% of their weight of solution. The impregnated chips were then digested in the vapor phase in the digester 4 for twenty minutes at 160° C. The digested chips were then defibrated at the same temperature under steam pressure in a disc refiner to a freeness of 800 ml. The pulp yield was 90.1%. No waste lignin-preserving bleaching liquor was added in this defibration stage.

The pulp was then separated into two portions. Portion A was diluted with pure water to a pulp consistency of 18%, and then refined in a disc refiner.

Portion B was also diluted to a pulp consistency of 18% but with an aqueous waste bleaching liquor containing 0.6 g hydrogen peroxide, 0.7 g NaOH, 2.0 g $Na_2SiO_3$, 0.03 g diethylenetriaminepentaacetic acid, and 0.02 g magnesium sulfate $MgSO_4$ per liter. In addition thereto the bleaching waste liquor also contained oxidized organic materials, similar to the bleaching waste liquor used in Example 1. The pH of the bleaching waste liquor was 9.5. Subsequent to a reaction time of 5 minutes at 75° C. the portion B was refined in the same manner as portion A. The two portions were then screened and dewatered, and tested for paper properties, with the results shown in Table II:

TABLE II

| | | CONTROL Portion A | EXAMPLE 2 Portion B |
|---|---|---|---|
| Freeness, CSF | | 240 ml | 250 ml |
| Fiber composition, Bauer McNett fractioning | + 20 mesh | 19.1% | 18.4% |
| | + 150 mesh | 53.7% | 55.4% |
| | − 150 mesh | 27.3% | 26.2% |
| Shives content, SOMMERVILLE | < 0.15 mm | 0.16% | 0.03% |
| Brightness, SCAN | | 54.5% | 62.3% |

As the data show, a more favorable fiber composition was obtained using the process of the invention (portion B), utilizing waste bleaching liquor. Moreover, the shives content was considerably reduced. A further advantage of the process of the invention was that the brightness of the unbleached portion B was higher than that of the unbleached portion A.

Both portions were then bleached with hydrogen peroxide using an aqueous bleaching liquor containing 1.5% $H_2O_2$, 3% $Na_2SiO_3$, 1.3% NaOH and 0.05% magnesium sulfate $MgSO_4$, all calculated on the bone dry weight of the pulp. The bleaching time was 120 minutes, and the pulp consistency 12%. The bleaching temperature was 65° C. The bleached pulps were then tested for paper properties, with the results shown in Table III.

TABLE III

| | CONTROL PORTION A | EXAMPLE 2 PORTION B |
|---|---|---|
| Brightness, SCAN | 60.2% | 68.2% |
| Ethanol extract | 0.54% | 0.15% |
| Breaking length | 3300 m | 4300 m |
| Tear factor | 70% | 78% |
| Absorptivity (g water/g pulp) | 10.2% | 13.3% |

The data in the Table show that the chemimechanical pulp manufactured in accordance with the invention, Portion B, is much brighter, and has a much lower extractives content, than the pulp produced in accordance with the prior art, portion A. In addition, the strength and absorptivity of the pulp are higher when the process of the invention is used.

In the above Examples, the process of the invention has been applied to the manufacture of chemimechanical pulp. However, the process of the invention also can be applied to any other pulp manufacturing process in which active pulping or digestion chemicals are not present when the lignocellulosic material is defibrated.

EXAMPLE 3

Spruce chips having a length of 40 mm, a width of 20 mm and a thickness of 3 mm, were processed using the system of FIG. 2. First, the chips were treated with steam in a vessel 2 at atmospheric pressure for fifteen minutes. The steam-moistened chips were then fed from the vessel 2 to the impregnating vessel 3 provided with a screw feeder, and impregnated with aqueous sodium bisulfite solution comprising 65 g of sodium hydroxide and 68 g of sulfur dioxide per liter, having a pH of 6.0. During impregnation of the chips with the bisulfite solution, the chips took up approximately 100% by weight of the solution. The impregnated chips were then passed to the digester 4, where they were mildly pulped in vapor phase for twenty minutes at 160° C. The digested chips were then passed to the defibrator 5, a disc refiner, and defibrated at the same temperature and a pulp consistency of 40% to a freeness of 610 ml. The partially delignified and defibrated suspension from the defibrator 5 was then passed to the hydrocyclone 10. In the hydrocyclone 10 the suspension was then diluted and cooled with cooled waste bleaching liquor containing 0.8 g hydrogen peroxide, 0.5 g NaOH, 25 g $Na_2SiO_3$, 0.03 g diethylenetriaminepentaacetic acid, and 0.02 magnesium sulfate, per liter of waste bleaching liquor. The waste bleaching liquor also contained oxidized organic material residues from the bleaching, mainly comprising fine fiber particles and organic acids. The pH of the waste bleaching liquor was 8.8. The cooled waste bleaching liquor was added by way of line 11 in FIG. 2.

After passing the hydrocyclone 10 the suspension was passed to the reaction vessel 23, where it was kept for 5 minutes at about 88° C., and thereafter passed to the second defibrator 12, where it was further defibrated to a pulp suspension. The pulp suspension was then passed via the equalizing vessel 24 to the screening section 7 and the dewatering section 8. The filtrate from the dewatering section 8 may, instead of being recycled to the screening section 7 via the collection vessel 18, be recovered in the recovery plant 20 either by being passed via vessel 17 or by being passed directly to the recovery plant 20 (not shown). A portion of the dewatered pulp suspension was then taken out at point B, shown in FIG. 2, and tested. The test results are shown in Table IV.

To evaluate the above results, a control run was made, using spruce chips of the same dimensions processed in the same manner as described in Example 3, but uncooled waste bleaching liquor was added not at the hydrocyclone 10, but after defibration to pulp was complete at the equalizing vessel 24. The pulp suspension in the equalizing vessel 24 was thereby diluted and somewhat cooled. The diluted pulp suspension had a temperature of about 96° C. Since no diluting and cooling took place in either the first defibrator 5 or in the second defibrator 12 in this case, the defibrations were each performed at a high temperature, 160° C. and a consistency of 40% in the first, and 155° C. and 42% in the second, defibrator. The fully defibrated pulp suspension from the second defibrator 12 had a freeness of 230 ml, and the yield was 88.7%.

A portion of the obtained dewatered pulp suspension was taken out at point B in FIG. 2 and tested. The test results are shown in Table IV.

TABLE IV

| Waste peroxide bleaching liquor recirculated to: | | Example 3 Hydrocyclone | Control Equalizing Vessel |
|---|---|---|---|
| Freeness, CSF | | 205 ml | 225 ml |
| Fiber composition, Bauer McNett fractonation | + 20 mesh | 7.5% | 7.5% |
| | + 150 mesh | 74.0% | 72.5% |
| | − 150 mesh | 18.5% | 20.0% |
| Brightness, SCAN | | 67.8% | 65.2% |
| Breaking length | | 4850 m | 4100 m |
| Tear factor | | 76 | 70 |
| Absorptivity (g water g pulp) | | 12.9 | 11.2 |

The date in Table IV show that the unbleached pulp produced in accordance with the invention of Example 3, where cooled waste bleaching liquor from a lignin-preserving bleaching stage was added to the partially digested and defibrated lignocellulosic material at the hydrocyclone 10, was brighter and stronger than the unbleached pulp produced in the control process, with no addition of waste bleaching liquor until the pulp was fully formed, i.e., with addition of the uncooled waste bleaching liquor after the final (second) defibration stage. Moreover, the unbleached pulp obtained by the process of the invention, Example 3, had a higher tear factor and a greater water absorptivity, both properties of significant importance influencing the field of application of the pulp.

The comparatively low brightness of the control pulp is mainly due to the fact that no cooling and diluting liquid was present during the defibration stage, which resulted in higher temperature during the defibration, and marked discoloration. The absence of cooling and diluting liquid in the defibration stage apparently also influenced the strength properties and the water absorptivity of the obtained pulp, all of which were inferior to the pulp of Example 3.

The dewatered pulp suspension of the invention from the dewatering section 8 in Example 3 was passed on to a mixer 28 and then subjected to a 120 minute single-stage lignin-preserving peroxide bleaching process in the bleaching tower 9, as illustrated in FIG. 2. The pulp suspension in the mixer 28 was mixed with an oxidizing bleaching solution 29 containing 2% hydrogen peroxide $H_2O_2$, 4% sodium silicate $Na_2SiO_3$, 1.5% sodium hydroxide NaOH, and 0.05% magnesium sulfate $MgSO_4$, all calculated on the bone dry weight of the pulp. The temperature during the bleaching was 65° C. and the pulp consistency 12%. The pulp after being passed through the dewatering section 14 was taken out at point C, and tested for brightness and paper properties. The results are shown in Table V.

For comparison, the dewatered pulp suspension of the Control was also bleached by the same process. The Control pulp suspension from the dewatering section 8 was subjected to a single-stage lignin-preserving bleaching process under identical conditions and using the same bleaching solution. The bleached fiber suspension was then thickened in the dewatering section 14, and the resulting pulp was taken out at point C and tested for brightness and paper properties. The test results are shown in Table V.

TABLE V

| Bleached pulp originating from: | Example 3 | Control |
|---|---|---|
| Brightness, SCAN | 73.7% | 71.5% |
| Ethanol extract | 0.19% | 0.38% |
| Breaking length | 5100 m | 4300 m |
| Tear factor | 78 | 71 |
| Absorptivity (g water/g pulp) | 13.0 | 11.1 |

The data in Table V show that the pulp of Example 3, manufactured in accordance with the invention, maintained its superiority in brightness and strength after bleaching, when compared with the control pulp. Though superior to conventional chemimechanical pulp, the control pulp had lower brightness, strength, and absorptivity, compared with the bleached pulp of Example 3. In addition, the bleached pulp of Example 3 had a much lower extractives content than the Control pulp.

The process in accordance with the invention makes it possible to manufacture high yield pulp at a lower cost than was ever considered possible. The quantity of bleaching chemicals required to achieve a given degree of brightness is less, and since the pulp is stronger than conventional high yield pulps, papers having a lower density can be made, without depreciation of the quality of the paper in other respects. If the paper is to be manufactured from chemimechanical or semichemical pulps mixed with chemical pulps, such as sulfate or sulfite pulps, the amount of chemical pulp can be reduced, and still give a paper of high quality and good properties, further reducing the cost for manufacturing such paper. The extractives content of the pulp produced in the process of the invention is greatly reduced, which is important in producing a paper having good water absorptivity and good brightness, and it is also an advantage in avoiding resin deposits. Furthermore, the chemicals used can be recovered with greater economy, because of the recycling of the waste bleaching liquor. Moreover, the process of the invention makes it possible to reduce discharge of contaminating waste materials, thus lessening pollution of the environment.

Having regard to the foregoing disclosure, the following is claimed as inventive and patentable embodiments thereof:

1. In the process for the manufacture of chemimechanical cellulose pulp in high yields within the range from about 65 to about 95% from particulate lignocellulosic material which comprises subjecting particulate lignocellulosic material to a mild partial digestion in the presence of a delignifying agent, and then mechanically defibrating the partially digested material, the improvement which comprises blending the partially digested lignocellulosic material after it has been defibrated to within the range from about 27 to about 44% of completion with waste bleaching liquor from a lignin-preserving bleaching process cooled to a temperature not exceeding 40° C.; and then completing the defibration to obtain a pulp of improved brightness and strength.

2. A process according to claim 1, in which the waste bleaching liquor is recycled lignin-preserving bleaching liquor from bleaching of chemimechanical cellulose pulp obtained from lignocellulosic material in the same chemimechanical manufacturing process.

3. A process according to claim 1, in which the bleaching liquor is added for cooling and dilution to a partially defibrated pulp suspension during defibration.

4. A process according to claim 3, wherein the waste bleaching liquor used as the diluting and cooling liquid also comprises fresh bleaching chemicals.

5. A process according to claim 1, in which aqueous defibrated pulp suspension obtained thereby is washed, screened and dewatered, and the dewatered cellulosic pulp is then bleached.

6. A process according to claim 5, in which the bleached pulp is dewatered in a second dewatering stage, and then bleached in a second bleaching stage performed with reducing bleaching agents.

7. A process according to claim 6, which comprises recovering the reducing waste bleaching liquor by passing said waste liquor directly to a chemicals recovery plant.

8. A process according to claim 1, wherein the defibrated pulp obtained thereby is bleached with a bleaching agent selected from the group consisting of hydrogen peroxide, sodium peroxide, peracetic acid, sodium dithionite, sulfur dioxide, sodium bisulfite, sodium sulfite, hydroxylamine, hydrazine, thiourea, and thioglycolic acid.

9. A process according to claim 1, in which the waste bleaching liquor is from a bleaching process where the bleaching agent is selected from the group consisting of hydrogen peroxide, sodium peroxide, peracetic acid, sodium dithionite, sulfur dioxide, sodium bisulfite, sodium sulfite, hydroxylamine, hydrazine, thiourea, and thioglycolic acid.

10. A process according to claim 9, in which the waste bleaching liquor is a peroxide bleaching liquor.

11. A process according to claim 9, in which the waste bleaching liquor is a dithionite bleaching liquor.

12. A process according to claim 1, in which the waste bleaching liquor has a pH within the range from about 6 to about 12.

13. A process according to claim 1, in which the lignocellulosic material is heated with steam prior to being defibrated in the presence of the waste bleaching liquor.

14. A process according to claim 1, wherein the waste bleaching liquor is mixed with a pH-adjusting solution prior to the blending with the particulate lignocellulosic material.

15. A process according to claim 1, which comprises recovering waste bleaching liquor from a bleaching stage, and recycling the waste bleaching liquor to the blending with the treated particulate lignocellulosic material.

16. A process according to claim 1, which comprises adding complexing agents to the defibrated material.

17. A process according to claim 1, which comprises steam-moistening the particulate lignocellulosic material, steam-heating the material at a temperature about 100° C., prior to partial digestion.

18. A process according to claim 1, which comprises steam-moistening the particulate lignocellulosic material, steam-heating the material at a temperature above 100° C., and then defibrating the material, in two stages adding the waste bleaching liquor as diluting and cooling liquor to the material prior to or during the second defibration stage.

19. A process according to claim 1, in which the partially digested particulate lignocellulosic material is defibrated in the presence of said delignifying agent to form cellulose pulp in the presence of waste bleaching liquor cooled to a temperature not exceeding 40° C.

20. A process according to claim 19, in which the particulate lignocellulosic material is heated with steam to moisten the chips, impregnated with a cellulose delignifying chemical, and then digested.

21. A process according to claim 19, in which the defibrated pulp suspension is screened and dewatered, and the dewatered defibrated cellulose pulp material is then bleached.

22. A process according to claim 21, in which the bleaching liquor is from a lignin-preserving bleaching process using a peroxide bleaching agent.

23. A process according to claim 22, in which the bleached pulp is passed to a second dewatering stage, followed by a second bleaching stage performed with a reducing bleaching agent.

24. A process according to claim 23, which comprises recovering the reducing waste bleaching liquor by passing said waste liquor directly to the chemicals recovery plant.

25. A process according to claim 21, wherein the dewatered defibrated cellulose pulp is bleached with a bleaching agent selected from the group consisting of hydrogen peroxide, sodium peroxide, peracetic acid, sodium dithionite, sulfur dioxide, sodium bisulfite, sodium sulfite, hydroxylamine, hydrazine, thiourea, and thioglycolic acid.

26. A process according to claim 25, in which the bleached pulp is passed to a second dewatering stage, followed by a second bleaching stage performed with reducing bleaching agents.

27. A process according to claim 19, in which the waste bleaching liquor has a pH within the range from about 6 to about 12.

28. A process according to claim 19, in which the lignocellulosic material is heated with steam and then defibrated in the presence of the waste bleaching liquor.

29. A process according to claim 28, in which the defibrated material is screened.

30. A process according to claim 28, wherein the waste bleaching liquor is mixed with a pH-adjusting solution prior to the blending.

31. A process according to claim 19, in which the cellulose delignifying chemical is selected from the group consisting of sodium bisulfite, sodium hydroxide, sodium carbonate and sodium bicarbonate, magnesium carbonate and magnesium bicarbonate.

32. A process according to claim 19, in which the mild digestion is effected at a temperature within the range from about 80° to about 180° 1 C., at a superatmospheric pressure within the range from 0 to 20 kp/cm$^2$, and the digestion is continued until a Kappa number within the range from about 50 to about 150 is obtained.

33. A process according to claim 19, in which the defibration is effected in a disc refiner at a temperature within the range from about 80° to about 180° C. at a superatmospheric pressure within the range from about 0.5 to about 10 kp/cm$^2$.

* * * * *

UNITED STATES PATENT AND TRADEMARK OFFICE

CERTIFICATE OF CORRECTION

PATENT NO. : 4,294,653

DATED : October 13, 1981

INVENTOR(S) : Jonas Arne Ingvar Lindahl

It is certified that error appears in the above-identified patent and that said Letters Patent are hereby corrected as shown below:

Column 2, line 38 : "small" should be --smaller--
Column 7, line 6 : "receiving" should be --preserving--
Column 12, Table III
lines 35 and 36 : delete "%" after "70", "78", "10.2" and "13.3"
Column 13, line 6 : "25g" should be --2.5 g--
Column 13, Table IV,
line 55 : "factonation" should be --fractionation--
Column 13, line 63 : "date" should be --data--
Column 16, line 29 : "about" should be --above--
Column 18, line 8 : "180°lC" should be --180°C--

Signed and Sealed this

*Twenty-sixth* Day of *March 1985*

[SEAL]

*Attest:*

DONALD J. QUIGG

*Attesting Officer* *Acting Commissioner of Patents and Trademarks*